US006010349A

United States Patent [19]

Porter, Jr.

[11] Patent Number: 6,010,349

[45] Date of Patent: Jan. 4, 2000

[54] LOCKING COUPLING ASSEMBLY

[75] Inventor: Frank Kendall Porter, Jr., Billerica, Mass.

[73] Assignee: Tensolite Company, Wilmington, Mass.

[21] Appl. No.: 09/090,435

[22] Filed: Jun. 4, 1998

[51] Int. Cl.[7] ..... H01R 4/38

[52] U.S. Cl. ..... 439/320; 439/578

[58] Field of Search ..... 439/320, 321, 439/322, 323, 338, 339, 340, 583, 584, 551, 641, 642, 643, 648, 661, 727, 784, 579, 578, 580, 581; 411/431, 222, 232, 223

[56] References Cited

U.S. PATENT DOCUMENTS 2,313,763 3/1943 Olsen ..... 411/223
4,698,028 10/1987 Caro et al. ..... 439/271

*Primary Examiner*—Paula Bradley
*Assistant Examiner*—Ross Gushi
*Attorney, Agent, or Firm*—Herbert L. Bello

[57] ABSTRACT

A cable connecting system for interconnection with a mating connector includes a connecting element, a first securing element, and a second securing element. The first securing element is rotatably mounted to the connector and the second securing member is rotatably mounted to the first securing element. In operation, the first and second securing elements are first threaded onto a receiving section of the mating connector. Once fully positioned on the receiving section of the mating connector, torque is applied in a conventional direction to the first securing element to secure the connecting element to the mating connector. Then, torque is applied in a counter direction to the second securing element to lock the first and second securing elements. The cable connecting system and the method of interconnection utilizing the cable connecting system is reversible so as to allow repeated connection and disconnection of various assemblies of cable assemblies.

22 Claims, 7 Drawing Sheets

LOCKING COUPLING ASSEMBLY

BACKGROUND OF THE INVENTION

1. Field of the Invention

The present invention relates to electrical connectors. It relates in particular to an apparatus and method for connecting and locking cable assemblies.

2. Description of the Prior Art

The use of coaxial cabling in high performance radio frequency applications creates a need for connector systems capable of coupling assemblies of coaxial cabling with minimal detriment to electrical efficiency and signal transmission. Maintaining an effective cable interconnection is difficult in dynamic environments where vibration and torsional forces are frequently experienced. Traditional coaxial radio frequency interfaces are mechanically fastened in a simple manner. The mechanical fastening means typically employs a first cylindrical shell with attached free bodied threaded coupling nut, and mating threaded second cylindrical shell. The mating first and second cylindrical shells, with appropriate interface features, form the outer conductor of the radio frequency coaxial transmission line. The coupling nut is the first means of co-locating and preloading these two elements for proper operation. The coupling nut is torqued relative to the mating threaded second cylindrical shell, preloading the first cylindrical shell to a value consistent with minimizing losses to the radio frequency signal as it passes through the interface. Dynamic environments can have a negative effect upon this traditional coaxial radio frequency interface. It often loosens in dynamic environments and transmission line losses become unacceptable.

Mechanical connection systems have been employed to achieve the desired interconnection of coaxial cabling. Traditionally, mechanical connectors have relied on screw threads on one plug, and a threaded collar on another plug to provide the desired cable interconnection. In operation, the two plugs are engaged and tightened to a specific torque in order to achieve the desired interconnection of the cables. Mechanical coupling systems of this type suffer from the disadvantage that they may become loose and adversely affect signal transmission.

A need exists for an improved apparatus and method that does not suffer from the limitations and disadvantages of prior devices and permits the locking interconnection of cable assemblies.

SUMMARY OF THE INVENTION

It is an object of the present invention to provide an apparatus and method for interconnecting cable assemblies which do not suffer from the foregoing disadvantages and limitations.

It is another object of the present invention to provide an apparatus and method for interconnecting cable assemblies via mechanical action and with minimal risk of subjecting the conducting elements of the cable to damaging or destructive forces.

It is another object of the invention to provide an apparatus and method for interconnecting cable assemblies that is uniformly effective under a variety of dynamic environmental conditions.

It is yet another object of the invention to provide an apparatus for interconnecting cable assemblies that is simple in construction and compact in design.

It is yet another object of the present invention to provide an apparatus for interconnecting cable assemblies that is easily and economically produced, and readily assembled.

Other general and specific objects of the invention will in part be obvious and will in part appear hereinafter.

The connector apparatus of the invention permits the repeated locking interconnection and disconnection of coaxial cables. The connector apparatus of the invention may also be used on panel mount connectors. For example, the connector apparatus of the invention may be used to connect coaxial cables to an electrical panel, airplane bulkhead surface, or marine bulkhead surface. Indeed, the connector of the invention can be employed in virtually any application which utilizes a standard coupling nut.

Typically, the coaxial cable with which the apparatus and method of the invention are utilized includes an inner conductor, an outer conductor, and a dielectric body electrically isolating the inner and outer conductors. The connector apparatus of the invention generally includes a connecting element, a first securing element, and a second securing element.

Generally, the connecting element is configured to receive a coaxial cable. The connecting element typically includes an inner contact element and an outer contact element. The inner conductor of the coaxial cable is in electrical contact with the inner contact element of the connecting element. The outer conductor of the coaxial cable is in electrical contact with the outer contact element of the connecting element. In the preferred embodiment of the invention, the connecting element includes a ferrule element sized and shaped to define the passage of the connecting element noted above. In addition, the preferred embodiment of the connecting element typically includes a casing element. The casing element generally includes a first forward section and second rearward section. The first forward section of the casing element is configured to movably seat the first securing element discussed below. The second rearward section of the casing element is configured to provide a protective enclosure for the ferrule element noted above.

The first securing element is mounted on the connecting element. Generally, the first securing element is movably, i.e., rotatably, seated relative to the connecting element. The first securing element has an inner surface including an attachment element. The attachment element is typically a series of spiral threads appropriate for a given application.

The second securing element is mounted on the first securing element. Generally, the second securing element is movably, i.e., rotatably, seated relative to both the first securing element and the connecting element. The second securing element has an inner surface including an attachment element. The attachment element is typically a series of spiral threads appropriate for a given application. The threads of the second securing element are typically substantially identical to the threads of the first securing element.

The invention also contemplates a method for the connecting of assemblies of coaxial cable. To commence the method of the invention, a connector apparatus of the type described above is mechanically attached to the end of a coaxial cable. Next, the coaxial cable with the connector apparatus of the invention attached thereto is placed in juxtaposition to a second coaxial cable assembly having a mating connector that mates with the connector apparatus embodying the invention. The second securing element of the connector apparatus of the invention is then brought into engagement with the mating connector of the second coaxial cable assembly. The second securing element is threaded onto the mating connector of the second coaxial cable. The first securing element is then brought into engagement with the mating connector of the second coaxial cable. Both the first securing element and second securing element are concurrently threaded onto the mating connector of the second coaxial cable. To complete the method of the invention, the first securing element is torqued in a first or customary direction to secure the cable assemblies mechanically for proper electrical response, the second securing element being loose. While holding the first securing element in place, the second securing element is torqued in a second direction that is counter to the first direction to lock the first and second securing elements and secure the mechanical characteristics of the interface. To disengage the apparatus of the invention from the second coaxial cable, the steps of the method of the invention are reversed.

The invention accordingly comprises the steps and apparatus embodying features of construction, combinations of elements and arrangements of parts adapted to affect such steps, as exemplified in the following detailed disclosure, the scope of the invention being indicated in the accompanying claims.

BRIEF DESCRIPTION OF THE DRAWINGS

A fuller understanding of the nature and objects of the present invention will become apparent upon consideration of the following detailed description taken in connection with the accompanying drawings in which.

DETAILED DESCRIPTION OF THE PREFERRED EMBODIMENTS

Figure 1:
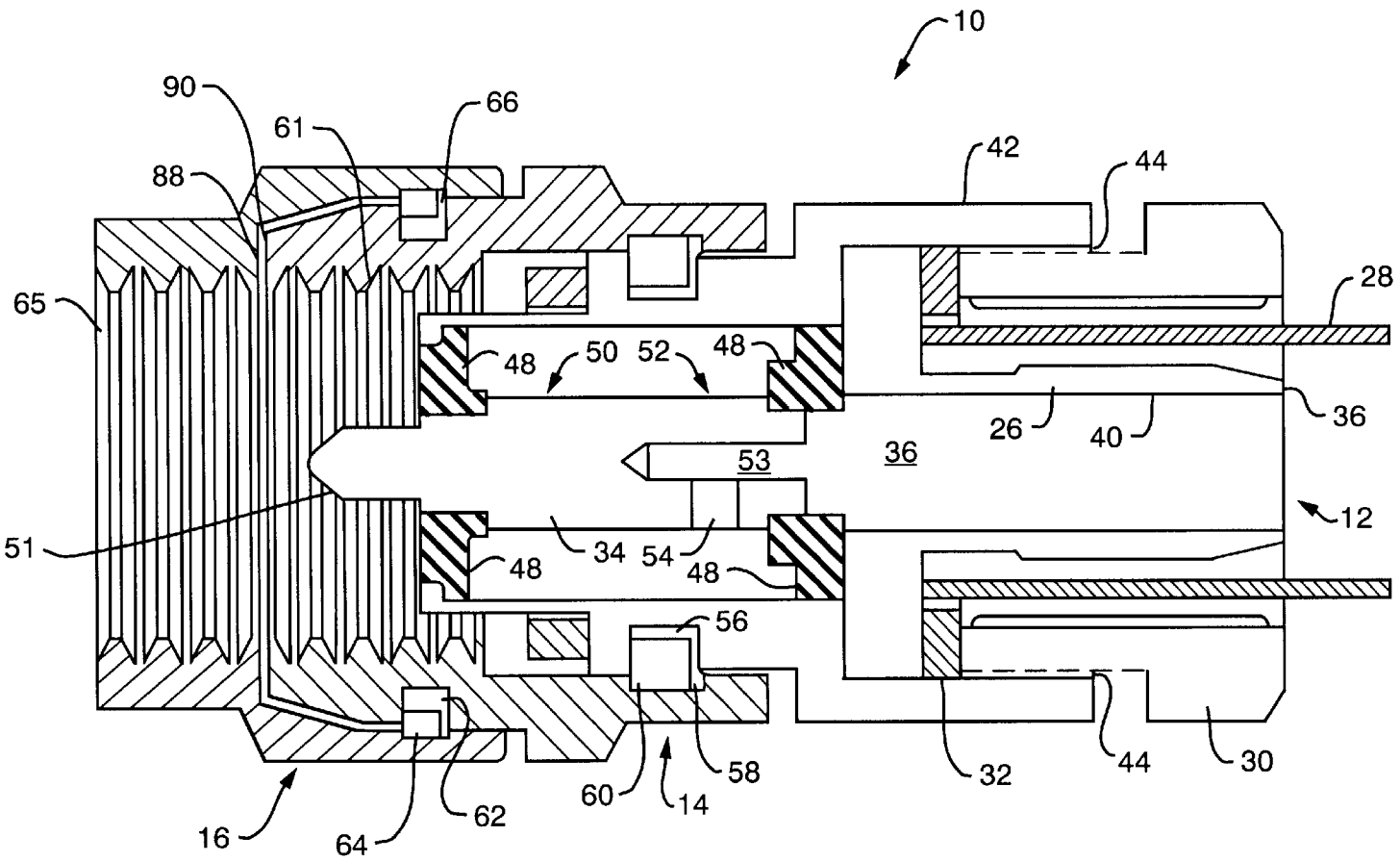
FIG. 1 is a side cut-away view of a locking coaxial cable connector embodying the invention.

Referring now to FIGS. 1 through 9, there is shown a locking coupling coaxial cable connector 10 embodying the invention. The connector 10 includes a connecting element 12, a first securing element 14 for mechanically coupling the connector, and a second securing element 16 for locking the first and second securing elements.

Referring now to FIG. 1, the connecting element 12 of the connector 10 is configured to assist in the interconnection of a coaxial cable. Generally such a coaxial cable includes an inner or central conductor, and an outer conductor which circumferentially surrounds the inner conductor. The cable can be either flexible, in which case the outer conductor is formed from a braided material, or semi-rigid, in which case the outer conductor is manufactured from a solid material. An insulator, which is composed of dielectric material, is disposed between inner conductor and outer conductor. The connecting element 12 generally includes a ferrule 26, a crimp sleeve 28, and a back unit 30. The ferrule 26 and back unit 30 are separated by a washer 32. The washer 32 serves to assist in the alignment and spacing of all of the components of the connecting element 12. Typically, the washer 32 is formed of a metallic substrate.

The ferrule 26 can have virtually any configuration familiar to those skilled-in-the-art. In a preferred embodiment of the invention, the ferrule 26 has an annular configuration sized and shaped to receive the coaxial cable. In operation, the ferrule 26 maintains the coaxial cable and center conductor in axial alignment. Such axial alignment is necessary so that the inner conductor can be properly connected to the contact element 34 described in detail below. An inner passage 36 of the ferrule 26 is in axial alignment with the contact element 34. A leading edge 36 of the ferrule 26 is tapered to facilitate insertion of the ferrule between the insulator and the outer conductor of the coaxial cable. The inner passage 36 of the ferrule 26 is slightly flared in order to facilitate entry, and positioning, of the coaxial cable in the ferrule 26. An inner surface 40 of the ferrule 26 is sized and shaped such that it can contact the insulator of the coaxial cable. The ferrule 26 is positioned within a casing element 42. The ferrule 26 acts as a support for the washer 32 and one end of the crimp sleeve 28. The thickness of the ferrule 26 can be modified as desired in order to provide adequate space for the coaxial cable, washer 32, and crimp sleeve 28.

As shown best in FIG. 1, the crimp sleeve 28 typically is thin-walled and has an annular configuration. The crimp sleeve 28 is sized and shaped such that it can encase the ferrule 26 yet be positioned within the confines of the back unit 30. In addition, the crimp sleeve 28 is configured such that it makes substantially complete surface-to-surface contact with the outer conductor of the coaxial cable. One end of the crimp sleeve 28 is preferably seated on the ferrule 26. The crimp sleeve 28 typically has an axial dimension selected so that at least a portion of it extends beyond the back unit 30. In order to facilitate compression of the crimp sleeve 28 into contact with the outer conductor of the coaxial cable, the crimp sleeve 28 is composed of a ductile material.

The back unit 30, which is also of annular configuration, extends axially rearward of the ferrule 26. The back unit 30 abuts the washer 32. The back unit 30 can have a series of equally spaced extensions 44 designed to engage an inner surface 46 of the casing element 42. In operation, the extensions 44 secure the back unit 30 in place vis-a-vis the casing element 42. The back unit 30 has an inner diameter sufficient to contain the ferrule 26 and the crimp sleeve 28. The back unit 30 can be formed from virtually any suitable durable, machinable material. In the preferred embodiment of the invention, the back unit 30 is composed of brass or stainless steel.

The contact element 34 is contained within the casing element 42. The contact element 34 is joined to the central conductor of the coaxial cable. To insure accurate alignment of the connected coaxial cable, the contact element 34 is coaxially positioned relative to the ferrule 26, back unit 30, and casing element 42. Generally, the contact element 34 has a rod-like configuration and is supported in position by an insulating element 48. Those skilled-in-the-art will appreciate that the contact element 34 can be composed of virtually any suitable material. In the preferred embodiment of the invention as depicted in the FIGURES, the contact element 34 is composed of, for example, brass or stainless steel.

The contact element 34 has a forward portion 50 and rearward portion 52. The forward portion 50 is configured as a male pin 51. The male pin 51 can have virtually any size and shape that permits connection of the connector 10 to another connector in the manner described in detail below. The rearward portion 52 is configured as a female receptacle 53. The female receptacle 53 is sized and shaped to receive the central conductor of the coaxial cable and establish an electrical connection or path between the central conductor of the coaxial cable and the male forward portion 50. A vent 54 is drilled radially through the rearward portion 52 to provide an exit for that air trapped in the rearward portion 52 during positioning of the connector 10 on a coaxial cable.

Supporting the contact element 34 is an insulating element 48. The insulating element 48 is generally disk-shaped and has a central aperture configured to receive the contact element 34. The insulating element 48 can be composed virtually of any suitable material exhibiting the desired insulating qualities. In the preferred embodiment of the invention as depicted in the FIGURES, the insulating element 48 is composed of plastic.

The ferrule 26, washer 32, contact element 34, and insulating element 48 are contained within the casing element 42. In the preferred embodiment of the invention as shown in the FIGURES, the casing element 42 has a generally tubular configuration. A forward portion of the casing element 42 has a groove 56 complementary in position to a groove 58 in the first securing element 14. The groove 56 is sized and shaped such that it can receive a load transfer ring 60. Once positioned in the grooves 56 and 58 of the casing element 42 and first securing element 14, respectively, the load transfer ring 60 secures the casing element 42 and first securing element 14 together. A rearward portion of the casing element 42 is configured to contain the ferrule 26, crimp sleeve 28, and back unit 30.

The first securing element 14 is mounted on the forward portion of the casing element 42. In the preferred embodiment of the invention as shown in the FIGURES, the first securing element 14 is sized and shaped so as to encase at least a portion of the casing element 42. Typically, the first securing element 14 has a tubular configuration. A forward internal surface of the first securing element defines a means of attachment and includes a series of threads 61 which are complementary to those on an element to which the connector 10 is connected during operation. The rearward internal surface of the first securing element 14 includes a groove 58 for receiving the load transfer ring 60. Once positioned in the grooves 58 and 56 of the first securing element 14 and the casing element 42, respectively, the load transfer ring 60 secures the first securing element 14 and casing element 42 together. Externally, a rearward portion of the first securing element 14 typically has a polygonal configuration that provides a means for the mechanical manipulation of the first securing element 14. As shown in the several FIGURES, the forward external portion of the first securing element 14 is sized and shaped to be positionable within the second securing element 16. The first securing element 14 also includes a groove 62 which is sized and shaped such that it can receive an integration ring 64. The integration ring 64 is configured to be positionable in a groove 66 in the second securing element 16. Once positioned in the grooves 62 and 66 of the first securing element 14 and second securing element 16, respectively, the integration ring 64 secures the first securing element 14 and second securing element 16 together. In the preferred embodiment of the invention as depicted in the FIGURES, the first securing element 14 is composed of brass or stainless steel.

The second securing element 16 is mounted on the forward portion of the first securing element 14. In the preferred embodiment of the invention as shown in the FIGURES, the second securing element 16 is sized and shaped so as to encase at least a portion of the first securing element 14. More particularly, a rearward internal portion of the second securing element 16 is complementary to the configuration of the forward external portion of the first securing element 14.

Typically, the second securing element 16 has a tubular configuration. As noted above, the rearward internal portion of the second securing element 16 defines a means of attachment and includes a groove 66 for receiving the integration ring 64. Once positioned in the grooves 62 and 66 of the first securing element 14 and the second securing element 16, respectively, the integration ring 64 loosely secures the first securing element 14 and second securing element 16 together. A forward internal surface of the second securing element 16 includes a series of threads 65 which are complementary to those on an element to which the connector 10 is connected during operation. Externally, at least a portion of the second securing element 16 typically has a polygonal configuration that provides a means for the mechanical manipulation of the second securing element 16. In the preferred embodiment of the invention as depicted in the FIGURES, the second securing element 16 is composed of brass or stainless steel.

Although the above-discussed FIGURES describe the use of grooves 62 and 66, in conjunction with an integration ring 64, in order to interconnect the first securing element 14 to the second securing element 16, those skilled-in-the-art will appreciate that the elements 14 and 16 can be secured together in other ways provided these elements remain independently rotatable relative to each other. Alternative interconnections are shown in FIGS. 6 through 9.

Figure 5:
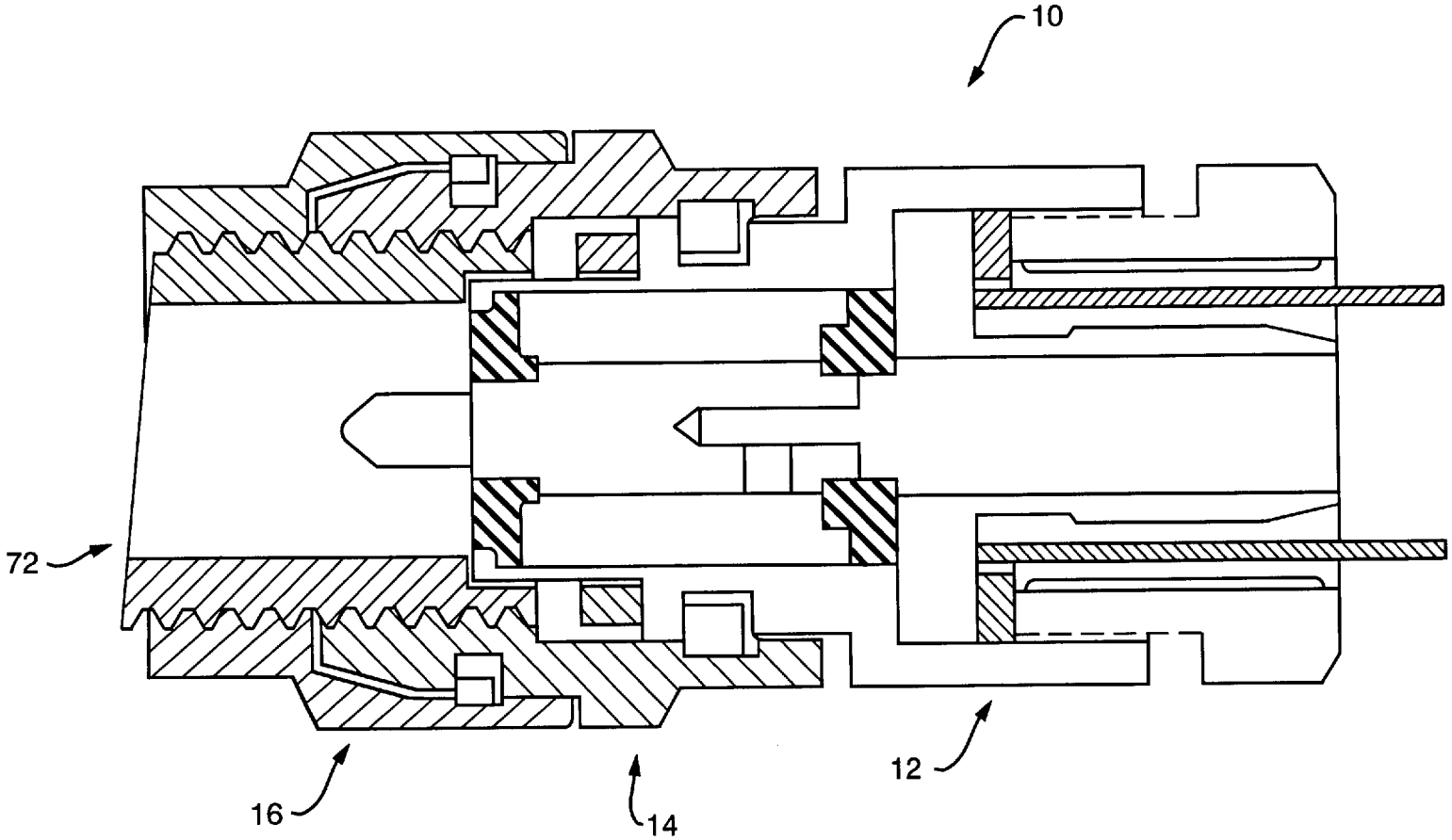
FIG. 5 is a side cut-away view of the locking coaxial cable connector embodying the invention in a tightened state.
Figure 7:
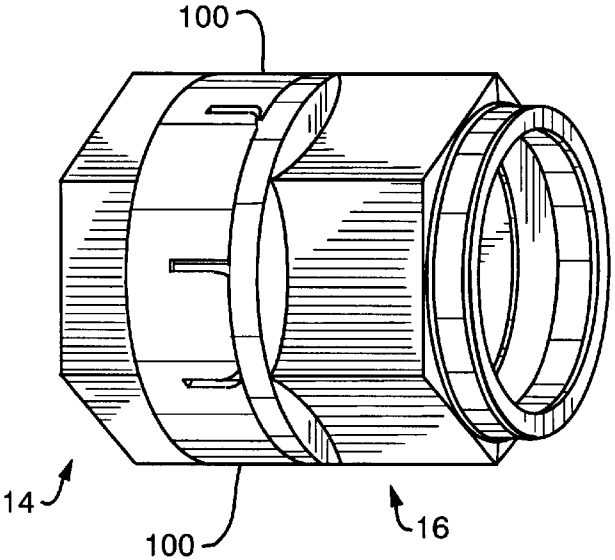
FIG. 7 is a perspective view of the locking coaxial cable connector of FIG. 6 after being fully assembled.
Figure 6:
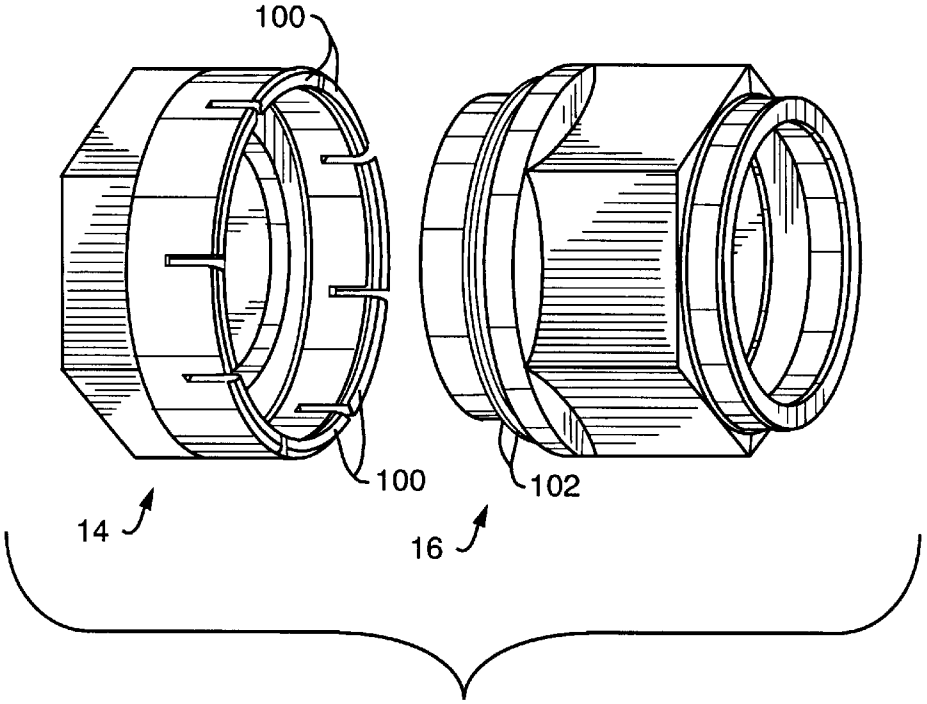
FIG. 6 is a perspective, exploded view of the locking coaxial cable connector embodying the invention having a first alternative interconnection system connecting the first securing element to the second securing element.

FIGS. 6 and 7 depict a first alternative configuration for the interconnection of the first securing element 14 and the second securing element 16. The internal configuration of the connecting element 12, first securing element 14, and second securing element 16 remains unchanged from that discussed in connection with FIGS. 1 through 5 for the embodiment of the invention shown in FIGS. 6 and 7. Externally, however, the first securing element 14 includes a series of tangs 100. The tangs 100 are circumferentially positioned about the forward section of the first securing element 14. The tangs 100 are sized and shaped to engage the rearward portion of the second securing element 16. More particularly, in this embodiment of the invention, the rearward portion of the second securing element 16 is sized and shaped to be positionable within the confines of the forward portion of the first securing element 14. The rearward portion of the second securing element 16 includes a series of grooves 102. When the apparatus of the invention 10 is assembled as shown in FIG. 7, the tangs 100 engage the grooves 102 so as to secure the first securing element 14 to the second securing element 16.

Figure 9:
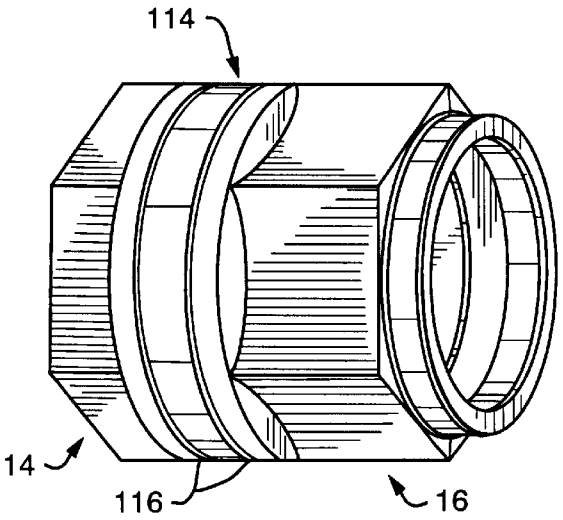
Figure 8:
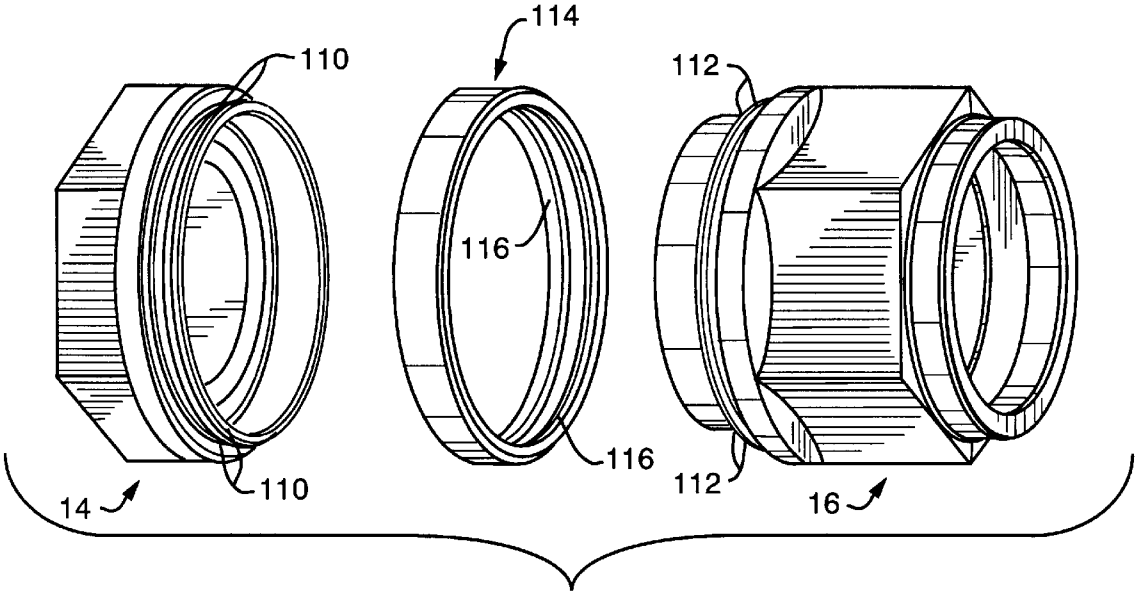
FIG. 8 is a perspective, exploded view of the locking coaxial cable connector embodying the invention having a second alternative interconnection system connecting the first securing element to the second securing element; and, FIG. 9 is a perspective view of the locking coaxial cable connector of FIG. 8 after being fully assembled.

FIGS. 8 and 9 depict yet another alternative configuration for the interconnection of the first securing element 14 and the second securing element 16. The internal configuration of the connecting element 12, first securing element 14, and second securing element 16 remains unchanged from that discussed in connection with FIGS. 1 through 5 in the embodiment of the invention shown in FIGS. 8 and 9. Externally, however, the forward portion of the first securing element 14 includes a series of grooves 110. Likewise, the rearward portion of the second securing element 16 also includes a series of grooves 112. An interconnection ring 114 is sized and shaped such that it is capable of encasing both the forward portion of the first securing element 14 and the rearward portion of the second securing element 16. The interconnection ring 114 can be manufactured from virtually any ductile, high strength material familiar to those skilled-in-the-art. Preferably, the interconnection ring 114 is manufactured from nylon. A pair of lips 116 extend circumferentially about the opposing edges of the interconnection ring 114. When the apparatus of the invention 10 is assembled as shown in FIG. 9, the lips 116 of the interconnection ring 114 engage the grooves 110 and 112 so as to secure the first securing element 14 to the second securing element 16.

Figure 2:
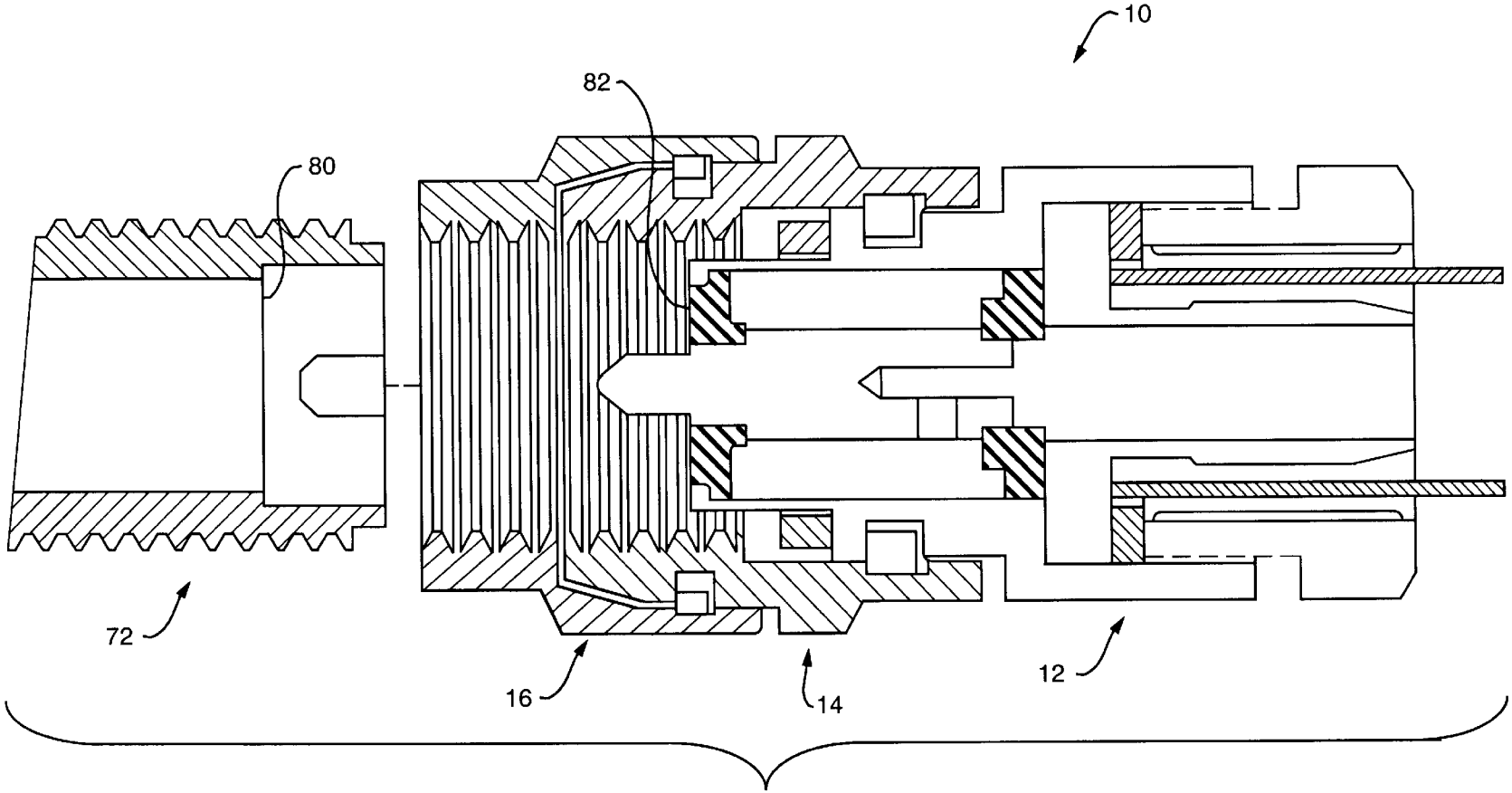
FIG. 2 is a side cut-away view of a locking coaxial cable connector embodying the invention with a receiving element being moved into engagement with the invention's second securing element.
Figure 3:
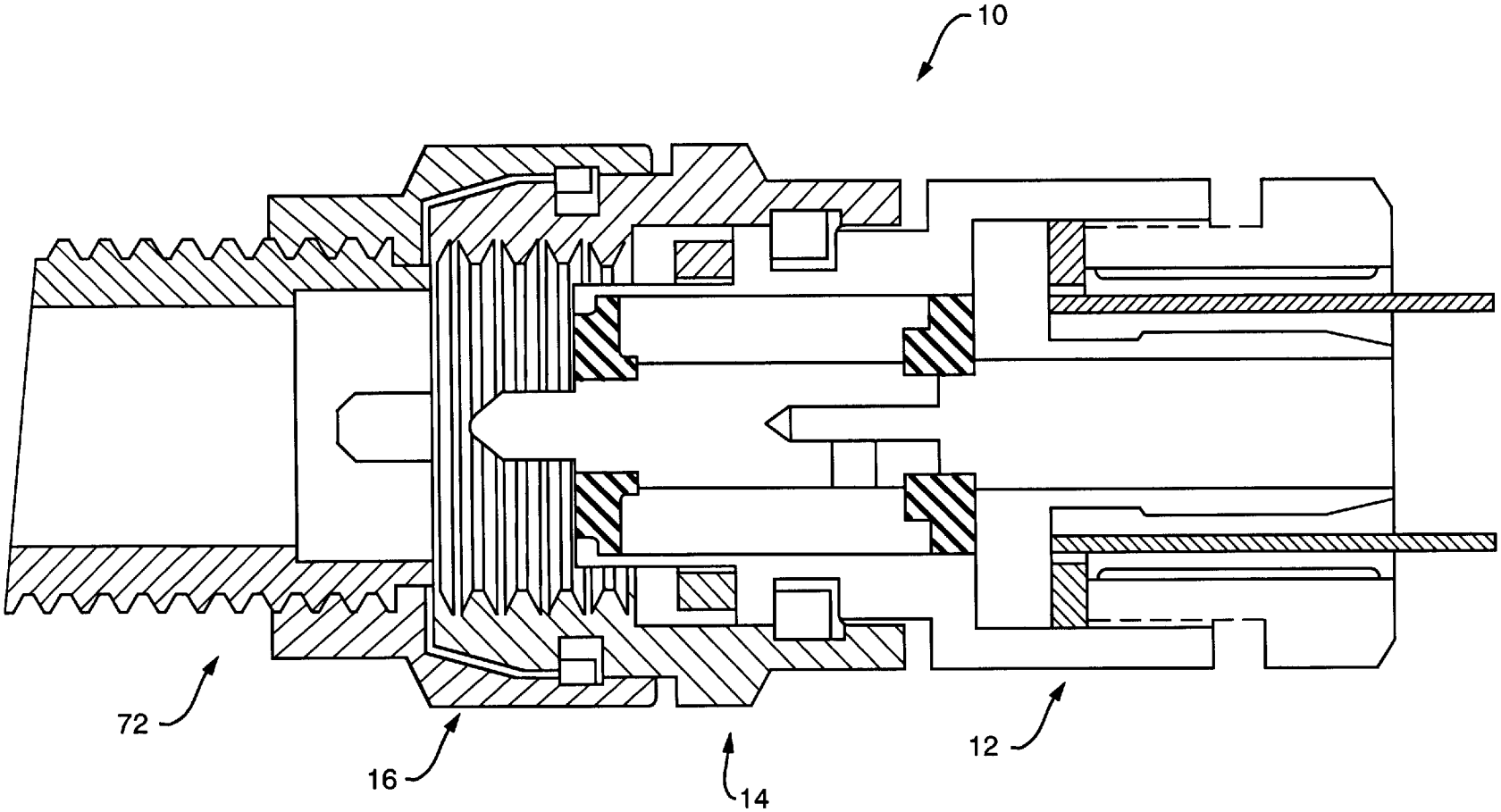
FIG. 3 is a side cut-away view of the locking coaxial cable connector embodying the invention with a receiving element engaging the invention's second securing element.
Figure 4:
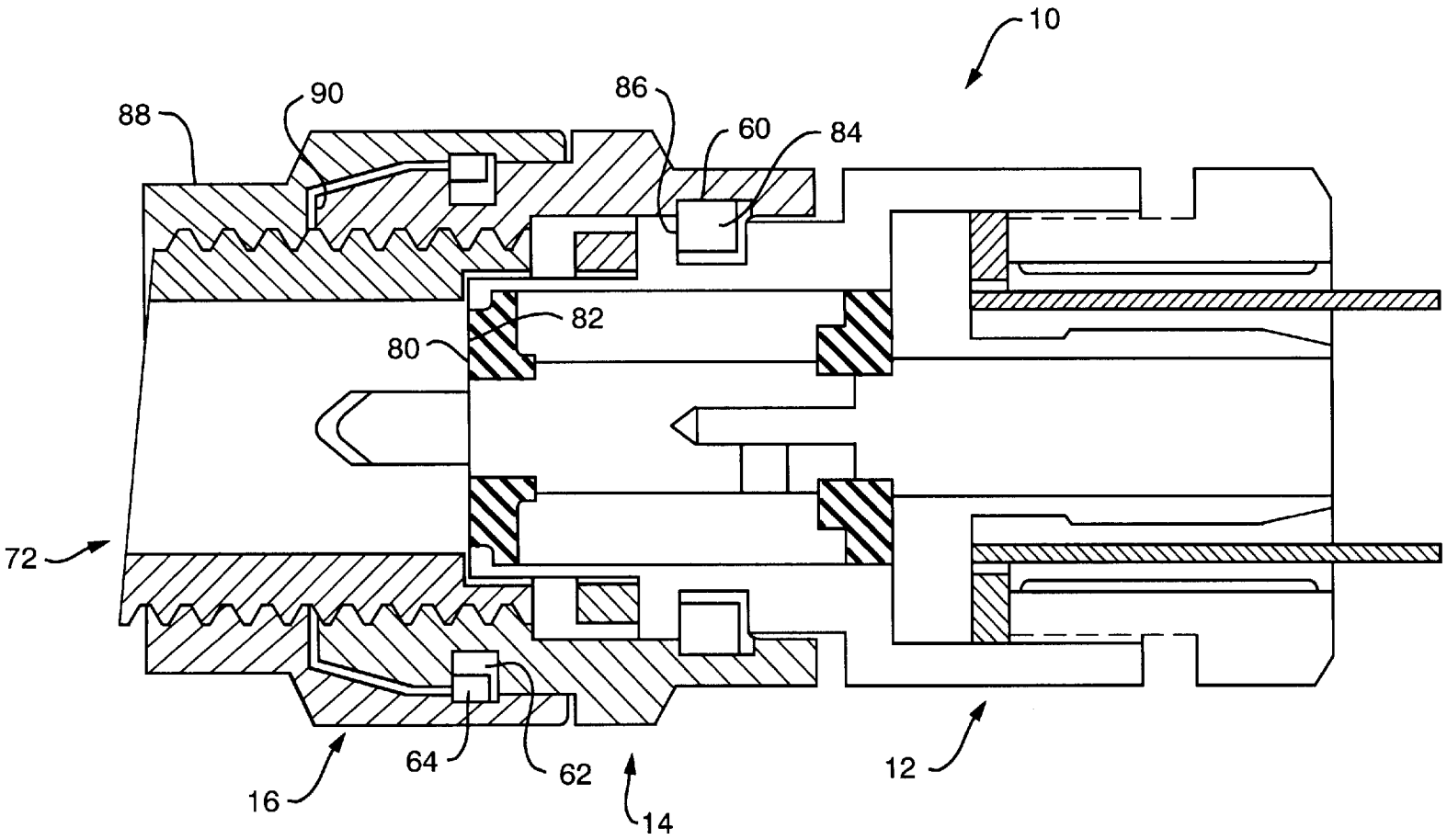
FIG. 4 is a side cut-away view of the locking coaxial cable connector embodying the invention in a pre-tightened state with a receiving element engaging the invention's first securing element and second securing element.

The connector 10 is secured to a connector 72 which is sized and shaped to mate with connector 10 by following the steps shown best in FIGS. 2 through 5. As shown in FIG. 2, to secure the connector 10 to mating connector 72, for example a coaxial cabling having an externally threaded male connector 72, the connector 10 is first moved into proximity with the threaded male end. As shown in FIG. 3, the first securing element 14 and the second securing element 16 are turned in a first or conventional direction to be threaded onto male connector 72. The first securing element 14 and the second securing element are turned until a compression surface 80 of male connector 72 is in contact with a compression surface 82 of connecting element 12 as shown in FIG. 4. The correct torque is applied to first securing element 14 to secure connector 10 to male connector 72. The compressive force at the compression surface 80 and compression surface 82 must be correctly established for proper operation of the interface as the outer shield of a transmission line for radio frequency signals. Operational compressive force at the compression surface 80 and compression surface 82 is established by controlled application of torque input to the rotation of the first securing element 14 connecting element 12. Load transfer occurs through tensile forces generated in securing element 14, reacting as a compressive force at a compression plane 84, a compression force in load transfer ring 60 and a compressive force at a compression plane 86. The compressive force at compression surfaces 80 and 82 is established for proper operation of the interface as the outer shield of a transmission line for radio frequency signals. At this time, second securing element 16 is in loose engagement with first securing element 14.

To complete the assembly procedure of the invention as shown in FIG. 5, the second securing element 16 is turned in a second or counter-conventional direction while the first securing element 14 is held in place, thus fully securing the connector 10 in position. Preferably, the same torque that was applied to first securing element 14 is applied as a counter-torque force to second securing element 16. Load occurs through bearing forces generated by second securing element 16 that react against the rotationally fixed first securing element 14. This results in a compressive force at a compression plane 88, a compression force at a compression plane 90. The compression force effectively increases the preload between the threaded portions of male connector 72 and the first securing element 14 without affecting the compressive force previously established at compression surfaces 80 and 82. As a result, there is an enhanced and reinforced connection between connector 10 and male connector 72.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall there between.

What is claimed is:

1. A locking coupling assembly for a coaxial cable, said locking coupling assembly being adapted to be removably and replaceably connected to a complementary coupling assembly the coaxial cable having an inner conductor and an outer conductor, a dielectric body electrically isolating the inner and outer conductors, said locking coupling assembly comprising:

(a) a connecting means, said connecting means configured to be connected to a coaxial cable;

(b) a first securing means mounted on said connecting means, said first securing means being constrained for rotatable movement relative to said connecting means, said first securing means having an inner surface, said inner surface of said first securing means having first attachment means; and (c) a second securing means operatively connected to one of said first securing means and said connecting means, said second securing means being constrained for rotatable movement relative to both said connecting means and said first securing means, said second securing means having an inner surface, said inner surface of said second securing means having second attachment means.

2. The coupling assembly of claim 1 wherein said first attachment means of said first securing means is first thread means.

3. The coupling assembly of claim 2 wherein said second attachment means of said second securing means is second thread means.

4. The coupling assembly of claim 3 wherein said first thread means and said second thread means are substantially identical thread means.

5. The coupling assembly of claim 1 wherein said connecting means includes a casing means, said casing means having a first forward section and second rearward section.

6. The coupling assembly of claim 5 wherein said first forward section of said casing means includes means for movably seating said first securing means on said connecting means.

7. Th e coupling assembly of claim 6 wherein said second securing means is rotatably mounted to said first securing means.

8. The coupling assembly of claim 1 wherein said first securing means and said second securing means are rotatable about a longitudinal axis of said connecting means.

9. A locking coupling assembly for a coaxial cable, said locking coupling assembly being adapted to be removably and replaceably connected to a complementary coupling assembly, the coaxial cable having an inner conductor and an outer conductor, a dielectric body electrically isolating the inner and outer conductors, said locking coupling assembly comprising:

(a) a connecting means having an inner contact means and an outer contact means, said inner contact means and said outer contact means being electrically insulated from one another, said connector means configured to receive a coaxial cable, one end of the coaxial cable received in said connecting means with said inner conductor of the coaxial cable being in electrical contact with said inner contact means and said outer conductor of the coaxial cable being in electrical contact with said outer contact means, said inner and outer connectors of the coaxial cable being electrically isolated from one another when secured in said connector means, the coaxial cable extending outwardly from said connecting means; and (b) a first securing means mounted on said connecting means, said first securing means being constrained for rotatable movement relative to said connecting means, said first securing means having an inner surface, said inner surface of said first securing means having a first attachment means; and (c) a second securing means operatively connected to one of said first securing means and said connecting means, said second securing means being constrained for rotatable movement relative to both said connecting means and said first securing means, said second securing means having an inner surface, said inner surface of said second securing means having second attachment means.

10. The locking coupling assembly of claim 9 wherein said first attachment means of said first securing means is first thread means.

11. The locking coupling assembly of claim 10 wherein said second attachment means of said second securing means are second thread means, said second thread means having a configuration that is substantially identical to said first thread means.

12. The locking coupling assembly of claim 9 wherein said connecting means includes a ferrule means, said ferrule means configured for telescopically receiving and supporting and locating the coaxial cable.

13. The locking coupling assembly of claim 12 wherein said connecting means includes a casing means, said casing means having a first forward section and second rearward section.

14. The locking coupling assembly of claim 13 wherein said first forward section of said casing means includes means for movably seating said first securing means on said connecting means.

15. The locking coupling assembly to claim 14 wherein said second securing means is rotatably mounted to said first securing means, said first and second attachment means being in spaced registration with one another and rotatable about a longitudinal axis of said connecting means.

16. A method for lockingly connecting a first coaxial cable in coaxial alignment to a second coaxial cable, said method comprising the steps of:

(a) providing a first coaxial cable connector, said first coaxial cable connector having a connector means, a rotatable securing means and a rotatable locking means, said securing means rotatably mounted to said connecting means, said locking means being mounted for rotational movement relative to said securing means;

(b) providing a second coaxial cable connector that is sized and shaped to mate with the first coaxial cable connector;

(c) connecting said first coaxial cable connector to the first coaxial cable;

(d) connecting said second coaxial cable to said coaxial cable connector;

(e) placing said locking means of said first coaxial cable connector in juxtaposition to the second coaxial cable connector;

(f) bringing said locking means of said first coaxial cable connector into engagement with the second coaxial cable connector;

(g) bringing said securing means of said first coaxial cable connector into engagement with the second coaxial cable connector while concurrently maintaining said engagement with said locking means;

(h) torquing said securing means of said first coaxial cable connector in a first direction for securing said securing means to said second coaxial cable connector, said locking means of said first coaxial cable connector being freely rotatable relative to said securing means; and (i) torquing said locking means of said first coaxial cable connector in a second direction that is opposite said first direction for locking said locking means and said securing means together in fixed relationship whereby the first coaxial cable connector is in locking engagement with the second coaxial cable connector.

17. The method of claim 16 wherein said step of bringing said locking means into engagement with the second coaxial cable connector includes the step of threading said locking means onto said second coaxial cable connector.

18. The method of claim 16 wherein said step of bringing said first securing means into engagement with the second coaxial cable connector includes the step of threading said securing means onto said second coaxial cable connector.

19. A coaxial cable connector assembly adapted to be in fixed locking engagement with a mating coaxial cable connector, said coaxial cable connector comprising:

(a) a coaxial cable having an inner conductor and an outer conductor, a dielectric body electrically isolating the inner and outer conductors;

(b) a connecting means having an inner contact means and an outer contact means, said inner contact means and said outer contact means being electrically insulated from one another, said connecting means configured to receive said coaxial cable, one end of said coaxial cable received in said connecting means with said inner conductor of said coaxial cable being in electrical contact with said inner contact means and said outer conductor of said coaxial cable being in electrical contact with said outer contact means, said inner and outer connectors of said coaxial cable being electrically isolated from one another when secured in said connector means, said coaxial cable extending outwardly from said connecting means; and (c) a first securing means mounted on said connecting means, said first securing means being constrained for rotatable movement relative to said connecting means, said first securing means having an inner surface, said inner surface of said first securing means having a first attachment means; and (d) a second securing means mounted on said first connecting means, said second securing means being constrained for rotatable movement relative to both said connecting means and said first securing means, said second securing means having an inner surface, said inner surface of said second securing means having second attachment means.

20. A locking coupling assembly adapted for fixed locking engagement of complementary electrical connectors, said locking coupling assembly comprising:

(a) a connecting means, said connecting means extending along a longitudinal axis;

(b) a first securing means mounted on said connecting means and constrained for rotatable movement about said longitudinal axis of said connecting means, said first securing means having an inner surface, said inner surface of said first securing means having a first attachment means; and (c) a second securing means operatively connected to one of said first securing means and said connecting means, said second securing means being rotatable relative to both said connecting means and said first securing means about the longitudinal axis of said connecting means, said second securing means having an inner surface, said inner surface of said second securing means having second attachment means;

(d) said first and second securing means being configured to be turned in opposite directions into engagement with one another, whereby compression forces are applied to said first and second securing means for fixed locking engagement of the complementary electrical connectors in fixed axial alignment.

21. The coupling assembly of claim 20 wherein said first attachment means of said first securing means includes first thread means and said second attachment means of said second securing means includes second thread means, said first thread means and said second thread means being substantially identical thread means.

22. The coupling assembly of claim 20 wherein said connecting means includes a casing means, said casing means having a first forward section and second rearward section, said first forward section of said casing means including means for movably seating said first securing means on said connecting means, said second securing means being rotatably mounted to said first securing means.

* * * * *